US008353653B2

(12) United States Patent
Guthrie et al.

(10) Patent No.: US 8,353,653 B2
(45) Date of Patent: Jan. 15, 2013

(54) ANCHOR BOLT PROVIDING FOR FALL PROTECTION

(76) Inventors: Karl Guthrie, Austin, TX (US); Joseph Schwartz, Wimberley, TX (US)

( * ) Notice: Subject to any disclaimer, the term of this patent is extended or adjusted under 35 U.S.C. 154(b) by 450 days.

(21) Appl. No.: 12/587,658

(22) Filed: Oct. 9, 2009

(65) Prior Publication Data

US 2011/0085873 A1 Apr. 14, 2011

(51) Int. Cl.
*F16B 21/00* (2006.01)

(52) U.S. Cl. ..... 411/344; 411/340; 411/345; 411/380; 411/401

(58) Field of Classification Search ..... 411/340, 411/341, 344, 345, 346, 400, 401, 380; 248/231.9, 248/925; 16/114.1, 418, 419, 420, 428
See application file for complete search history.

(56) References Cited

U.S. PATENT DOCUMENTS 3,948,485 A * 4/1976 Chouinard et al. ..... 248/694
4,572,464 A * 2/1986 Phillips ..... 248/231.9
4,715,568 A * 12/1987 Best, Jr. ..... 248/231.9
4,834,327 A * 5/1989 Byrne ..... 248/231.9
5,253,964 A * 10/1993 Swemmer ..... 411/79
5,484,132 A * 1/1996 George et al. ..... 248/231.9
6,109,578 A * 8/2000 Guthrie et al. ..... 248/231.9
6,119,993 A * 9/2000 Youngblood et al. ..... 248/231.9
7,011,281 B2 * 3/2006 Guthrie et al. ..... 248/231.31
2005/0104385 A1 * 5/2005 Guthrie et al. ..... 292/247
2008/0253860 A1 * 10/2008 McDuff et al. ..... 411/344
2011/0225793 A1 * 9/2011 Daniels, III ..... 29/428

OTHER PUBLICATIONS

DB Industries, Inc., User Instruction Manual: Saflok Concrete Wedge Anchor, May 20, 2009, Capital Safety, p. 1 of 16.*
Mountain Gear, web page at "http://www.mountaingear.com/pages/product/product.asp/imanf/DMM/idesc/Dragon+Cam/Store/MG", publication date unknown.
Mountain Gear, web page at "http://www.mountaingear.com/pages/product/product.asp/imanf/Omega+Pacific/idesc/Link+Cam+Set+-2/Store/MG/item/114316/N/1045", publication date unknown.
Mountain Gear, web page at "http://www.mountaingear.com/pages/product/product.asp/imanf/Moses+Enterprises/idesc/Tomahawk", publication date unknown.
PK Safety Supply, web page at "http://wwwstore.pksafetynet/dbi-2100085.html", publication date unknown.

* cited by examiner

*Primary Examiner* — Roberta Delisle
(74) *Attorney, Agent, or Firm* — Portland Intellectual Property, LLC

(57) ABSTRACT

An anchor bolt providing for fall protection. The anchor bolt has an anchoring device that may be of any standard type, for making use of an aperture either in or through a structure as an anchoring point, an elongate flexible member connected to the anchoring device at one end of the elongate flexible member, and a handle connected to a second end of the flexible member. The handle member is pivotally attached to the second end, for pivoting about the elongate axis of the flexible member as it extends from the second end. Preferably, the anchoring device is a novel, toggling type in which a toggling member is pivotally attached to the flexible member at a ball joint.

21 Claims, 9 Drawing Sheets

ANCHOR BOLT PROVIDING FOR FALL PROTECTION

FIELD OF THE INVENTION

The present invention relates to an anchor bolt for temporary placement in a structure, which can be natural or man-made, to provide fall protection for climbers or workers.

BACKGROUND

In rock climbing and in construction, temporary bolts are often used to tether the climber or worker to an existing structure, such as a rock formation or the skeletal structure of an office building, so that if the climber or worker falls, the fall is short rather than deadly.

A common type of anchor bolt employs a mechanism or device that is generally adapted to engage the boundary, sides, or periphery of a hole or crevice by effective dimensional expansion, creating a frictional force of engagement. Such anchor bolts may be suitably termed "expansion bolts." Expansion type anchor bolts typically use chocks or wedges that are remotely manually manipulated to produce a change in effective diameter or size, such as described in U.S. Pat. No. 5,484,132 (see FIGS. 1 and 2) and U.S. Pat. No. 5,253, 964 (see FIG. 3). They may be especially adapted for use in drilled holes, such as those described in U.S. Pat. No. 7,011, 281 (see FIG. 4), or for use in irregularly shaped crevices, such as described in U.S. Pat. No. 4,715,568 (see FIG. 5).

The anchoring device portion of an anchor bolt can be as simple as a single, irregularly shaped chock that is, directly, manually manipulated within a crevice to present an effective size that prevents pulling the chock out of the crevice, as exemplified in U.S. Pat. No. 3,948,485 (see FIG. 6).

Another type of anchor bolt is that described in U.S. Publication No. 2005/0104385 (see FIG. 7), which employs a remotely manually manipulated, elongate toggling member as the anchoring device, that can be pivoted between a first orientation, in which the elongate axis of the toggling member is oriented substantially with the axis of the hole, to permit insertion into and through a hole, and a second orientation, in which the toggling member is oriented substantially perpendicular to the axis of the hole, so that it can span the hole and engage adjacent surfaces, and so cannot be pulled back through the hole.

The aforedescribed anchoring devices must be connected to a user to provide fall protection to the user. A typical form of connection is to provide a handle that can be grasped by the user's hand. The handle may also, or alternatively, be used or adapted for connecting to additional safety devices, such as a lanyard, rope or cable for, tethering the user to the anchor bolt.

Finally, the handle is connected to the anchoring device portion of the anchor bolt by a rope or cable. The use of a flexible tensile member, as opposed to, e.g., the rigid threaded rod used in the typical molly bolt, is highly advantageous, for rendering the anchor bolt resistant to shear forces. The flexible tensile member also, to a lesser extent, facilitates the user's mobility. There remains a need, and it is an objective of the present invention, to further facilitate the user's mobility.

SUMMARY

An anchor bolt providing for fall protection is disclosed herein. The anchor bolt has an anchoring device that may be of any standard type, for making use of an aperture either in or through a structure as an anchoring point, an elongate flexible member connected to the anchoring device at one end of the elongate flexible member, and a handle connected to a second end of the flexible member. The handle member is pivotally attached to the second end, for pivoting about the elongate axis of the flexible member as it extends from the second end. Preferably, the anchoring device is a novel, toggling type in which a toggling member is pivotally attached to the flexible member at a first ball joint.

The toggling-type anchoring device, or "toggle bolt," may be provided apart from the pivotally attached handle member, but preferably has additional features, that may be provided separately or in any permissible combination. One of these additional features is that the toggling member is elongate and has a maximum dimension in a direction perpendicular to its elongate axis, wherein the maximum dimension defines a diameter of a cylindrical surface of the toggling member.

Where the toggling member is elongate, another of these additional features is that it has a substantially planar surface that is substantially perpendicular to its elongate axis when it is in a locking position in which the toggling member cannot be removed through the aperture 15, without substantial resistance.

Where the aperture is a drilled hole, the toggle bolt preferably includes a hole plug slidably disposed about the flexible member, the hole plug having a substantially cylindrical hole plugging portion.

Where the toggle bolt includes a hole plug, it preferably includes a spring for biasing the hole plug toward said toggling member.

Another of these additional features is an elongate control member pivotally attached to the toggling member for remotely pivoting said toggling member. Where the toggle bolt includes a hole plug, the control member preferably extends through the hole plug.

Where the toggle bolt includes an elongate control member, it is preferably pivotally attached to the toggling member at a second ball joint.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

DETAILED DESCRIPTION OF PREFERRED EMBODIMENTS

Figure 1:
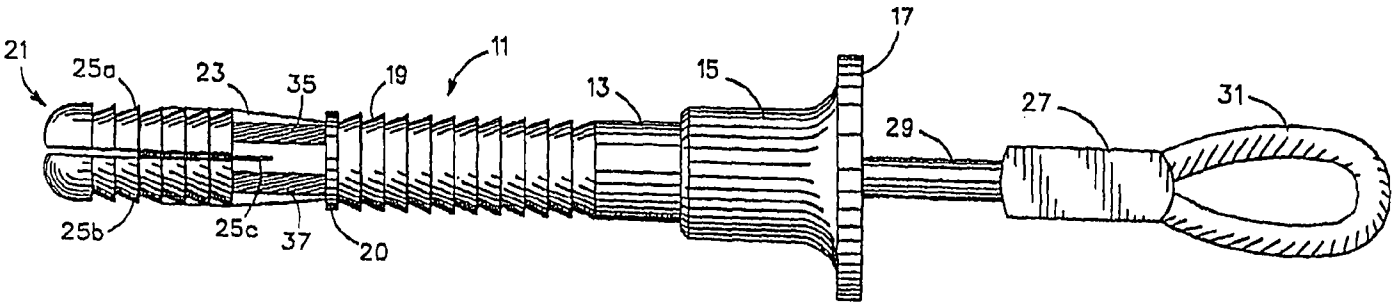
Fig. 1 (PRIOR ART)
FIG. 1 is a reproduction of FIG. 1 of U.S. Pat. No. 5,484, 132 (reference designators therefore are to be disregarded for purposes herein).
Figure 2:
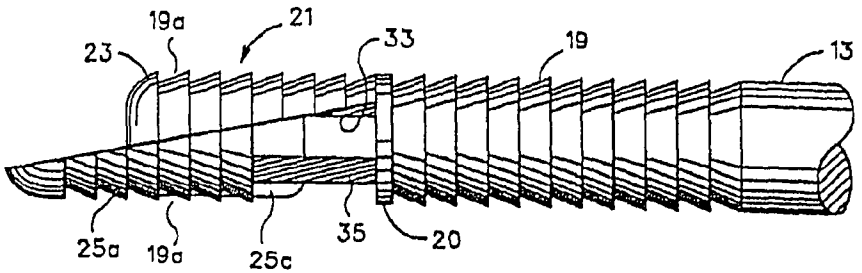
Fig. 2 (PRIOR ART)
FIG. 2 is a reproduction of FIG. 2 of U.S. Pat. No. 5,484, 132 (reference designators therefore are to be disregarded for purposes herein).
Figure 3:
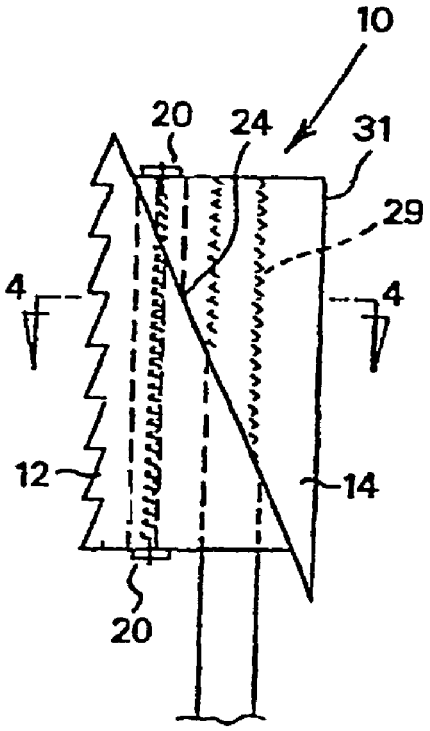
Fig. 3 (PRIOR ART)
FIG. 3 is a reproduction of FIG. 3 of U.S. Pat. No. 5,253, 964 (reference designators therefore are to be disregarded for purposes herein).
Figure 6:
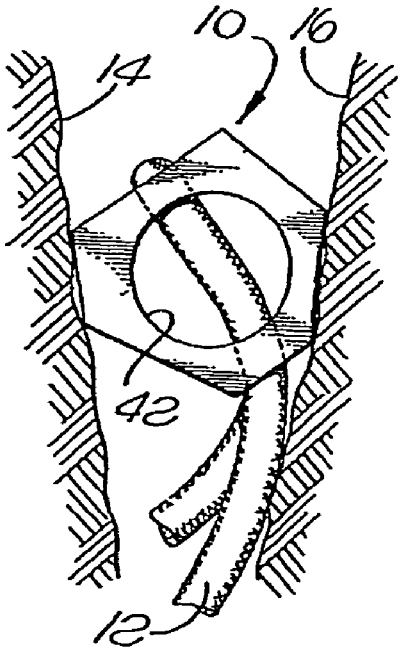
Fig. 6 (PRIOR ART)
FIG. 6 is a reproduction of FIG. 1 of U.S. Pat. No. 3,948, 485 (reference designators therefore are to be disregarded for purposes herein).
Figure 4:
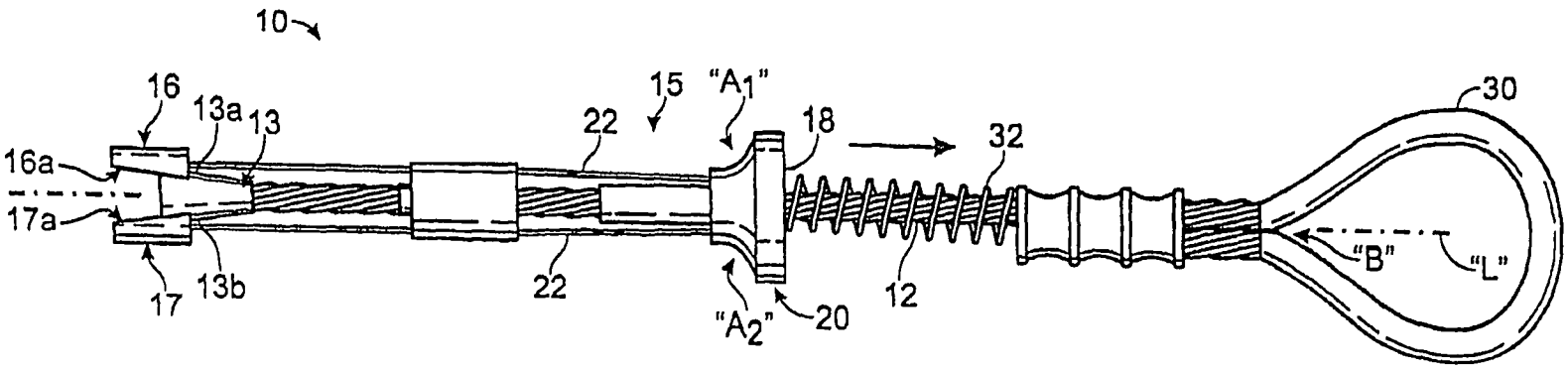
Fig. 4 (PRIOR ART)
FIG. 4 is a reproduction of FIG. 1 of U.S. Pat. No. 7,011, 281 (reference designators therefore are to be disregarded for purposes herein).
Figure 5:
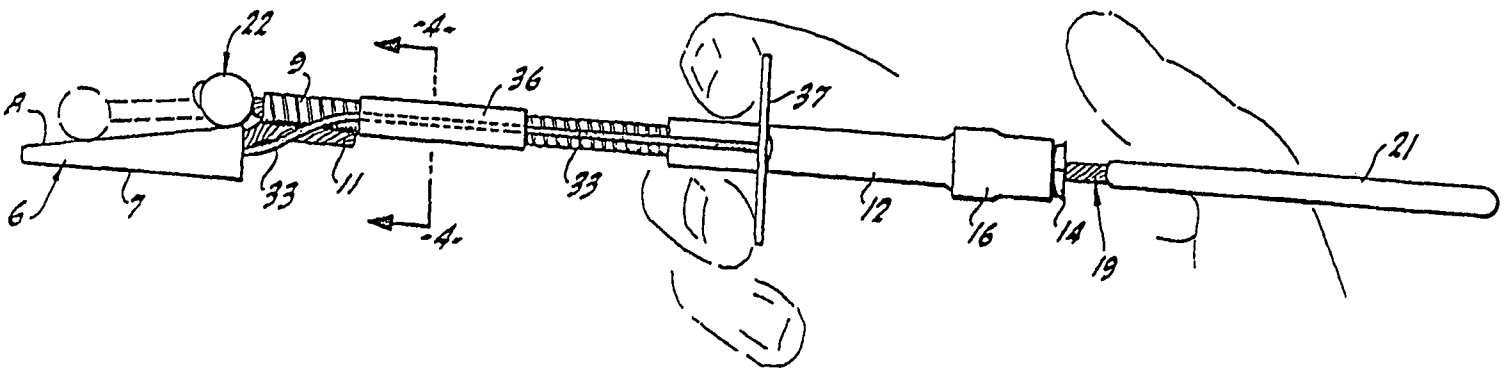
Fig. 5 (PRIOR ART)
FIG. 5 is a reproduction of FIG. 2 of U.S. Pat. No. 4,715, 568 (reference designators therefore are to be disregarded for purposes herein).
Figure 7:
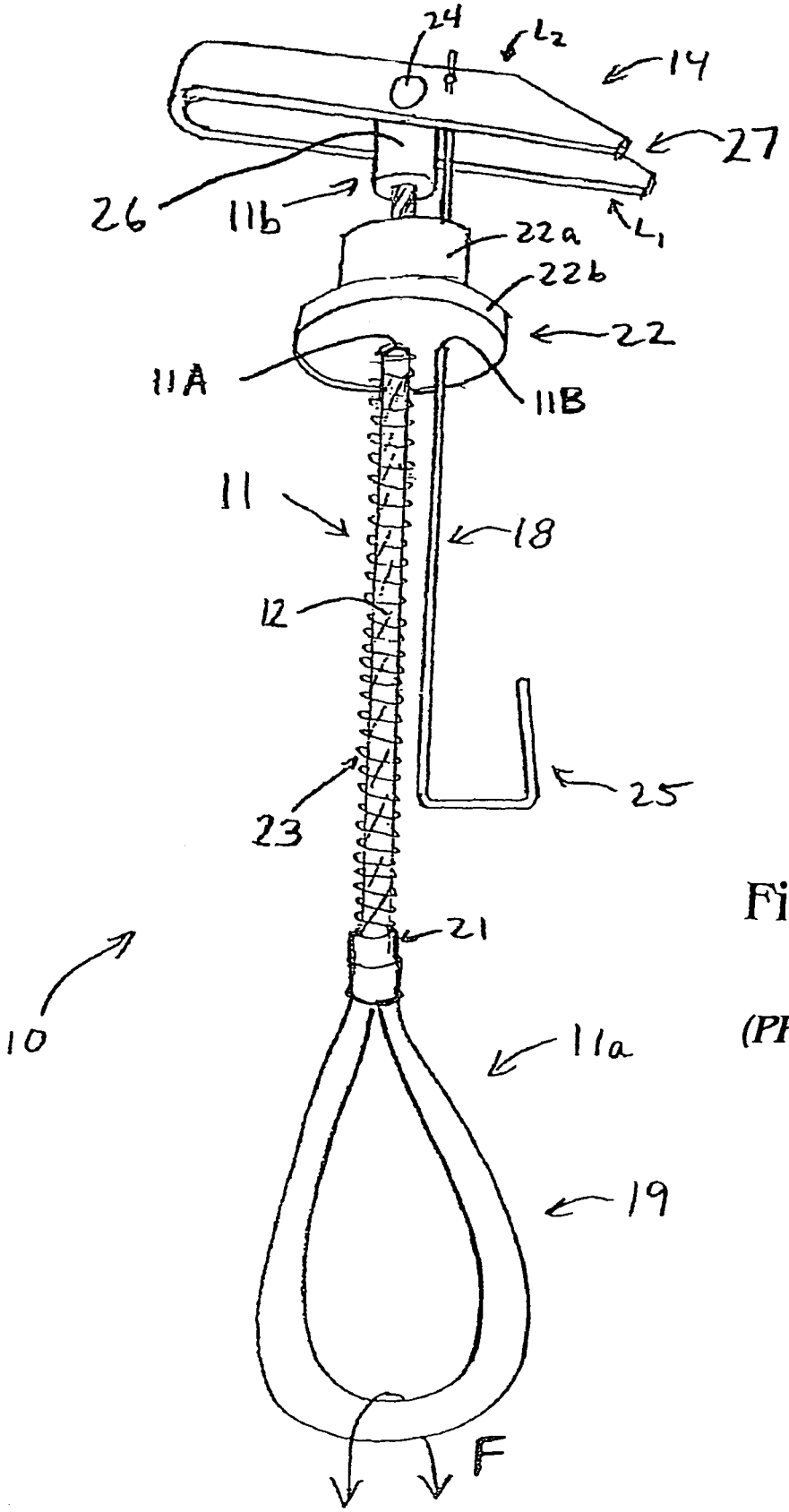
Fig. 7 (PRIOR ART)
FIG. 7 is a reproduction of FIG. 1 of U.S. Publication No. 2005/0104385 (reference designators therefore are to be disregarded for purposes herein).
Figure 8:
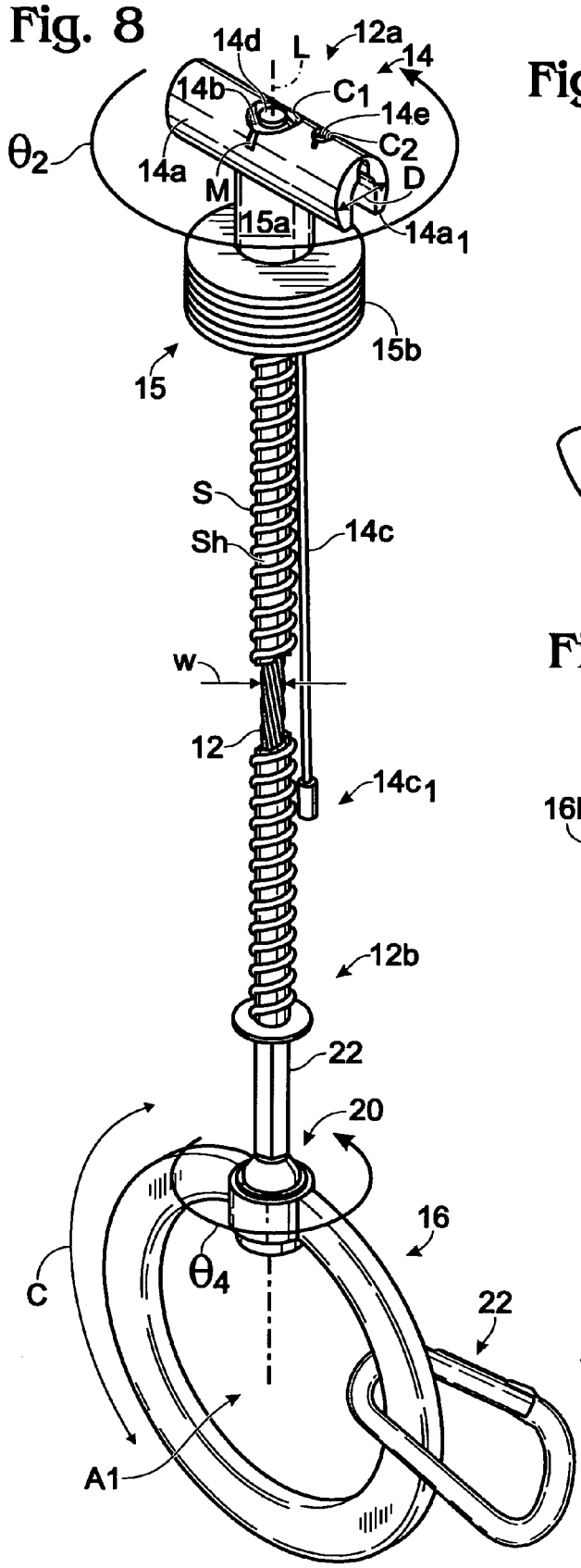
FIG. 8 is a three-dimensional view of an exemplary anchor bolt providing for fall protection according to the invention, showing an anchoring device in a first position.

FIG. 8 shows a preferred embodiment 10 of an anchor bolt providing for fall protection according to the invention. The anchor bolt 10 is based on an elongate flexible tensile member which will generically be referred to hereinafter as a "cable" 12 that defines a longitudinal or elongate axis "L," it being understood that a rope, chain, filament or other similar or equivalent elongate flexible member could be used. The cable 12 may be any length (measured along the axis L) but is typically about 5-24" long, and has a relatively small width "w" (measured perpendicular to the axis L), such as about ⅛-¾", preferably 7/32-5/16".

The cable 12 is sufficiently strong in tension that it can support at least 1,800 pounds of force without breaking, yet it is flexible in the sense that the axis L may adopt a significant temporary curvature as a result of bending forces applied perpendicular to thereto. More particularly, with reference to FIG. 9, the cable 12 should be flexible enough to provide, and is referred to hereinafter as being "flexible" if it provides, in response to a force applied as indicated, an angle θ that can be at least 90 degrees without permanent deformation or breakage of the cable.

To obtain the required combination of strength and flexibility, the cable 12 is typically formed of a number of discrete filaments stranded together. The filaments are strong in tension and, being thin, are flexible. A large number of filaments provides the necessary tensile strength while their bending capabilities are substantially retained by permitting them to slide relative to one another. Typically the filaments are wound together in slightly helical configurations, which assists to provide bending flexibility. The filaments are typically formed of metal, plastic, or carbon fiber, but may be formed of any suitable material. The cable 12 is preferably surrounded by a sheath "Sh," which is preferably formed of plastic.

The cable 12 has two ends 12*a* and 12*b*, which are preferably opposite ends, and is used to flexibly couple respective connection members provided at the respective ends. One of these connection members provided at the end 12*a* is an anchoring device 14 adapted to anchor the anchor bolt to a structure, and the other of the connection members provided at the end 12*b* is a handle 16 adapted for connecting to the user of the device, such as by the user manually grasping the handle, or the user attaching to the handle another connecting member, such as a lanyard, strap, or additional cable.

The anchoring device 14 for purposes of the present invention may be any suitable anchoring device, such as any of those anchoring devices described above in connection with FIGS. 1-7, where all of the publications from which FIGS. 1-7 were taken are incorporated by reference herein in their entireties. Such devices are generally adapted to make use of an aperture in or through a structure as a means for making a strong physical connection to the structure, and are inserted into, and in some cases through, the aperture. Exemplary structures are rock formations and buildings, but any object capable of supporting the aforementioned load may be utilized. In the case of rock formations, the aperture is typically a crevice, whereas in a building, the aperture is typically a drilled hole, but other forms or configurations of apertures may also be used.

Anchoring devices may be generally described as being adapted, by use of manual manipulation that is either direct or remote, so that a user can cause the anchoring device to adopt at least two different configurations or orientations, more particularly a relatively contracted or narrow configuration or orientation in which the anchoring device is effectively dimensionally suited to manual insertion into or through the aperture, and a relatively expanded or bluff configuration or orientation in which the anchoring device is effectively dimensionally unsuited to removal from or through the aperture without substantial resistance, preferably at least the 1,800 pound force that the anchor bolt should be capable of supporting. It should be understood that, beyond the need to perform the required function, any anchoring device may be used in accordance with the invention.

In a preferred embodiment of the invention, however, the anchoring device 14 is substantially as shown in FIG. 8. The anchoring device 14 as shown functions substantially as described in the '385 Publication, being of a toggle type, for use with a drilled through-hole and inserted through the hole (see FIG. 12; hole 13). An exemplary toggle member 14*a* is shown with its elongate axis substantially perpendicular to the axis L. This is the relatively expanded or bluff configuration mentioned above, and will be referred to below as the "locked position" for convenience.

Preferably, a substantial portion of the outer surface of the toggling member 14*a* is cylindrical. More particularly, the toggling member defines a maximum dimension "D" perpendicular to the axis "L," where D defines the diameter of a cylinder. Thus as shown, the cylindrical surface extends over at least 180 degrees.

The toggle member 14 is pivotally retained by a ball element 14*b* (best seen in FIGS. 12-14) in a suitably shaped cavity "$C_1$" in the toggle member. The ball member is retained at the end 12*a* of the cable 12, such as by a cap 14*d* that is swaged onto the cable end. The ball element is retained in the cavity by deforming the sides of the cavity, such as by a swaging operation, after the ball has been disposed therein (see tool mark "M," resulting from squeezing the sides of the toggle member together).

The ball joint thus formed is distinguished by providing for rotations of the toggle member 14*a* about both azimuthal $\theta_2$ and altitude $\theta_3$ angles, thus providing for 2 degrees of freedom. While the use of the spherical ball element 14*b* to provide this functionality is highly preferred, any joint providing the same functionality is to be considered a ball joint for purposes herein.

More particularly, the joint 20 provides for pivoting the toggle member through an azimuth angle of more than 360 degrees about the axis L relative to a fixed orientation of the cable 12 (i.e., a fixed degree of twist of the cable 12 about the axis L), while at all such angles allowing for an altitude angle $\theta_3$ in the range 0-90 degrees in the manner described further below.

A slender control rod 14*c*, which is preferably flexible by being either hardened or formed as a stranded cable like the cable 12, is likewise secured by a ball element 14*e* in another suitably shaped cavity "$C_2$" in the cylinder, to allow the cylinder to pivot relative to the control rod 14*c*.

Figure 10:
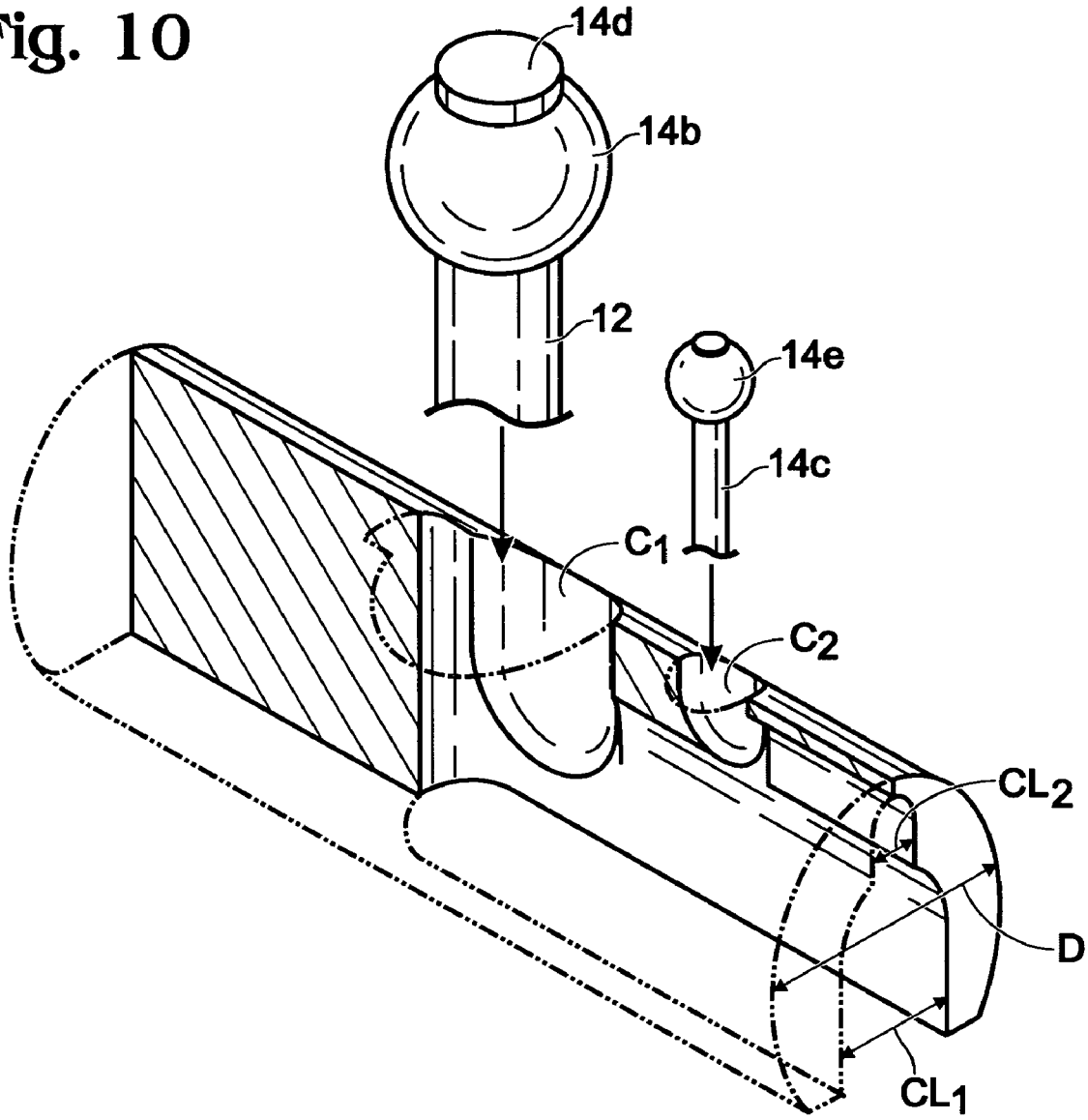
FIG. 10 is a semi-cutaway exploded isometric view of a toggling member of the anchoring device of FIG. 8.

FIG. 10 shows the toggling member 14*a* and its manner of attachment to the cable 12, and the ball joint thus formed, in more detail. The clearances $CL_1$ and $CL_2$ are provided so that the toggling member can clear, respectively, the cable 12 and the control rod 14*c*, when the toggling member is in the position shown in FIG. 11, which is the relatively contracted or narrow configuration or orientation mentioned above, which will be referred to below as the "unlocked position" for convenience. The positions of the toggling member shown in FIGS. 8 and 11 are described below in connection with FIGS. 12-14.

Figure 11:
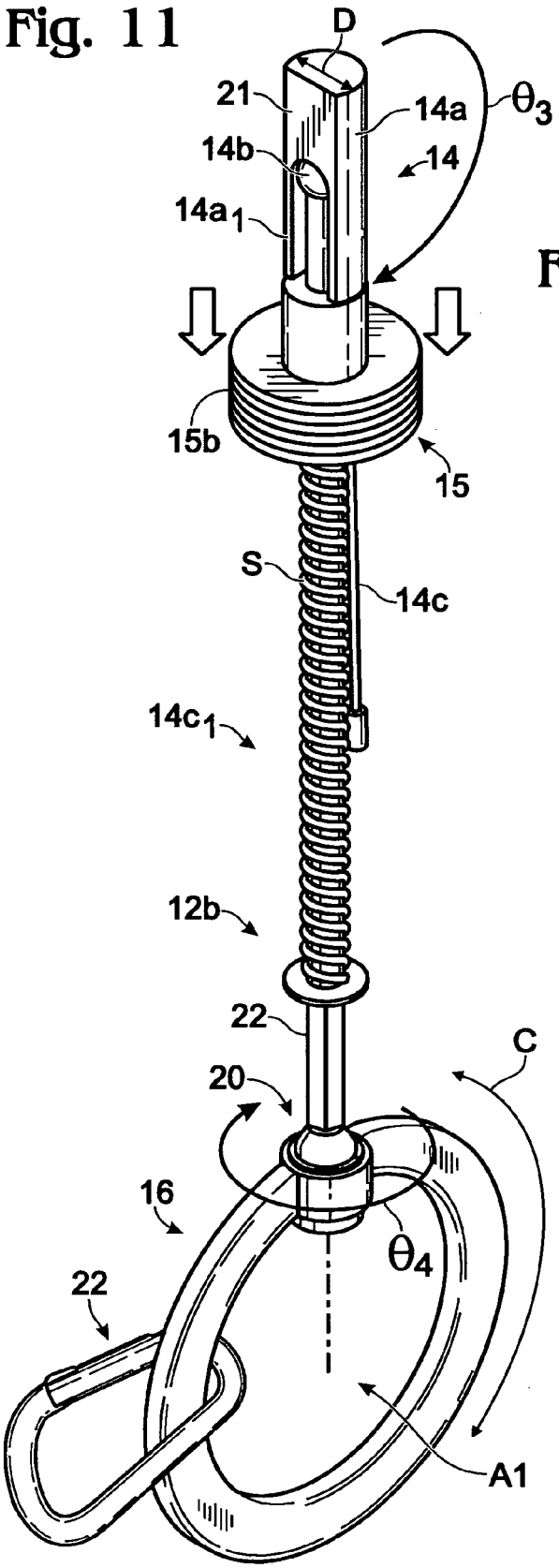
FIG. 11 is a three-dimensional view of the anchor bolt of FIG. 8, showing the anchoring device in a second position.
Figure 14:
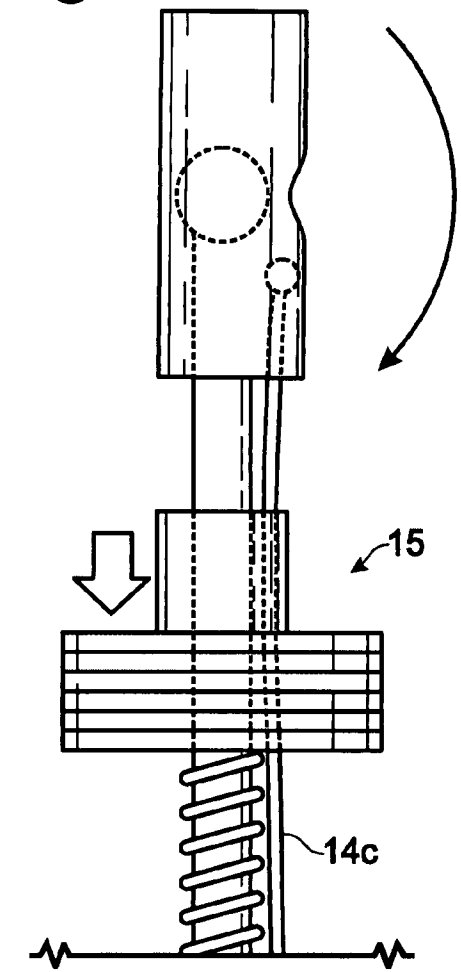
FIG. 14 is a side elevation of the anchoring device portion of FIG. 12 in the second position of FIG. 11.
Figure 13:
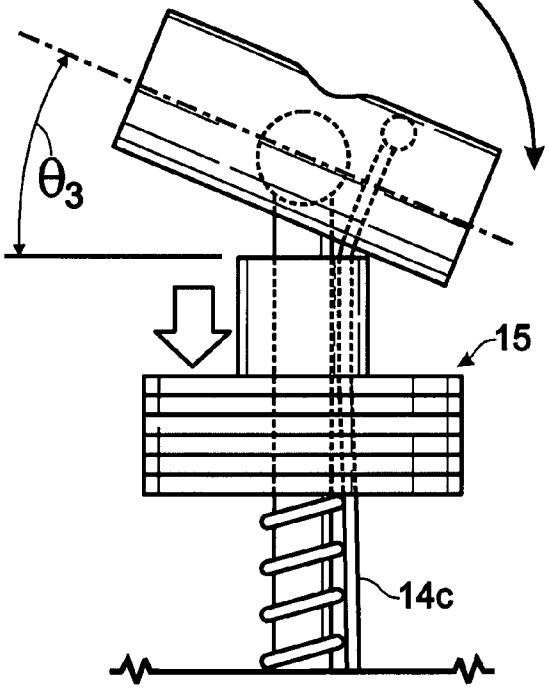
FIG. 13 is a side elevation of the anchoring device portion of FIG. 12 in an intermediate position between the first position of FIG. 8 and the second position of FIG. 11.
Figure 12:
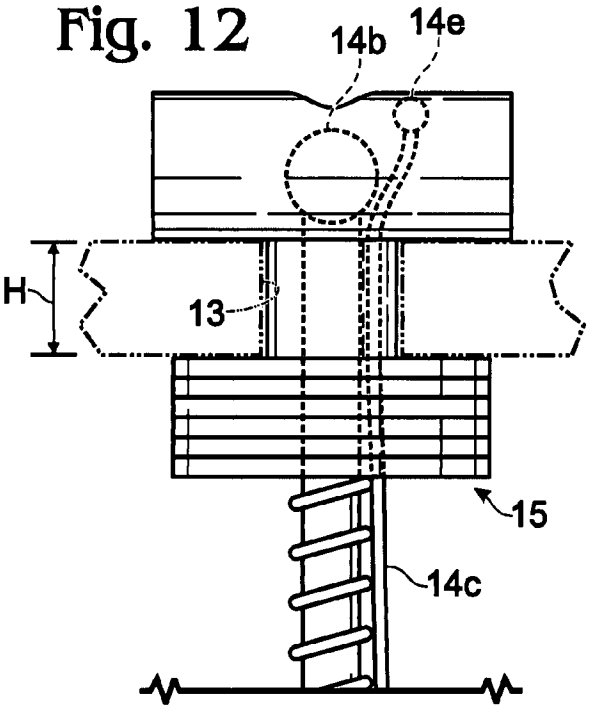
FIG. 12 is a side elevation of the anchoring device portion of the anchoring bolt of FIG. 8 in the first position.

As shown in both FIGS. 8 and 11, a hole plug 15 is slidably disposed on the cable 12, biased toward the anchoring device 14 by a coaxial spring "S." The control rod 14*c* extends through an internal hole through the hole plug, as can be understood by reference to FIGS. 12-14, that is aligned with the axis L. The orientation of the control rod therefore remains aligned with the cable 12.

The ball element 14*d* is secured in the cavity $C_2$ of the toggle member 14 in the same manner that the ball element 14*b* is secured in the cavity $C_1$.

The hole plug 15 has a hole plugging portion 15*a* that is sized to fit into the hole, particularly the interior cylindrical surface of the hole, with a slight clearance which, specified in terms of the hole diameter, is about 1-10% of the hole diameter, to permit manual insertion. Also, the depth "H" of the hole plugging portion (see FIG. 12) is preferably substantially the same as the depth of the hole, so that the bottom 14*a*$_1$ of the cylinder 14*a* is spaced evenly with the inside surface of the object (e.g., wall, ceiling, or floor) through which the hole extends. Therefore, the anchoring device is preferably especially adapted to suit the size of the hole and the thickness of the object.

The hole plug 15 also has a flanged, gripping portion 15*b* that is preferably ribbed or knurled to facilitate grasping the fingers and pulled downwardly, against the bias of the spring S, to provide clearance for the cylinder 14*a* to pivot about the ball element 14*b* so that its elongate axis can become substantially parallel to the axis L, and therefore adopt the "relatively contracted or narrow configuration or orientation" mentioned above, as shown in FIG. 11.

The toggle member 14*a* can be pivoted remotely, by pulling on the control rod 14*c*, such as at the end 14*c*$_1$.

FIGS. 12-14 show a sequence in which the toggle member is rotated by changing the altitude angle $\theta_2$ (identified in FIG. 13) from zero degrees (FIG. 12), corresponding to the locked position, to 90 degrees (FIG. 14), corresponding to the unlocked position, by pulling downwardly on the hole plug 15 and pulling downwardly on the control rod 14*c*.

The cylindrical portion of the toggle member 14*a* is also preferably of substantially the same diameter as that of the hole plugging portion 15*a*. The generally cylindrical shape of the toggle member 14*a* assists in guiding the anchoring device through the hole.

While much of the exterior surface of the toggling member 14*a* is cylindrical, it preferably has a planer bottom surface 21, as best seen in FIG. 11. This is provided so that the toggling member can rest stably on the similarly planer topmost surface of the hole plugging portion 15*b* (not visible) in the locked position. Mating planer surfaces are preferred, although other complementary mating shapes could be used to serve this purpose.

The handle 16 is provided for connecting the user to the anchor bolt. FIGS. 8 (and 9, 11), 15 and 16 show exemplary embodiments of handles that serve this purpose.

Figure 9:
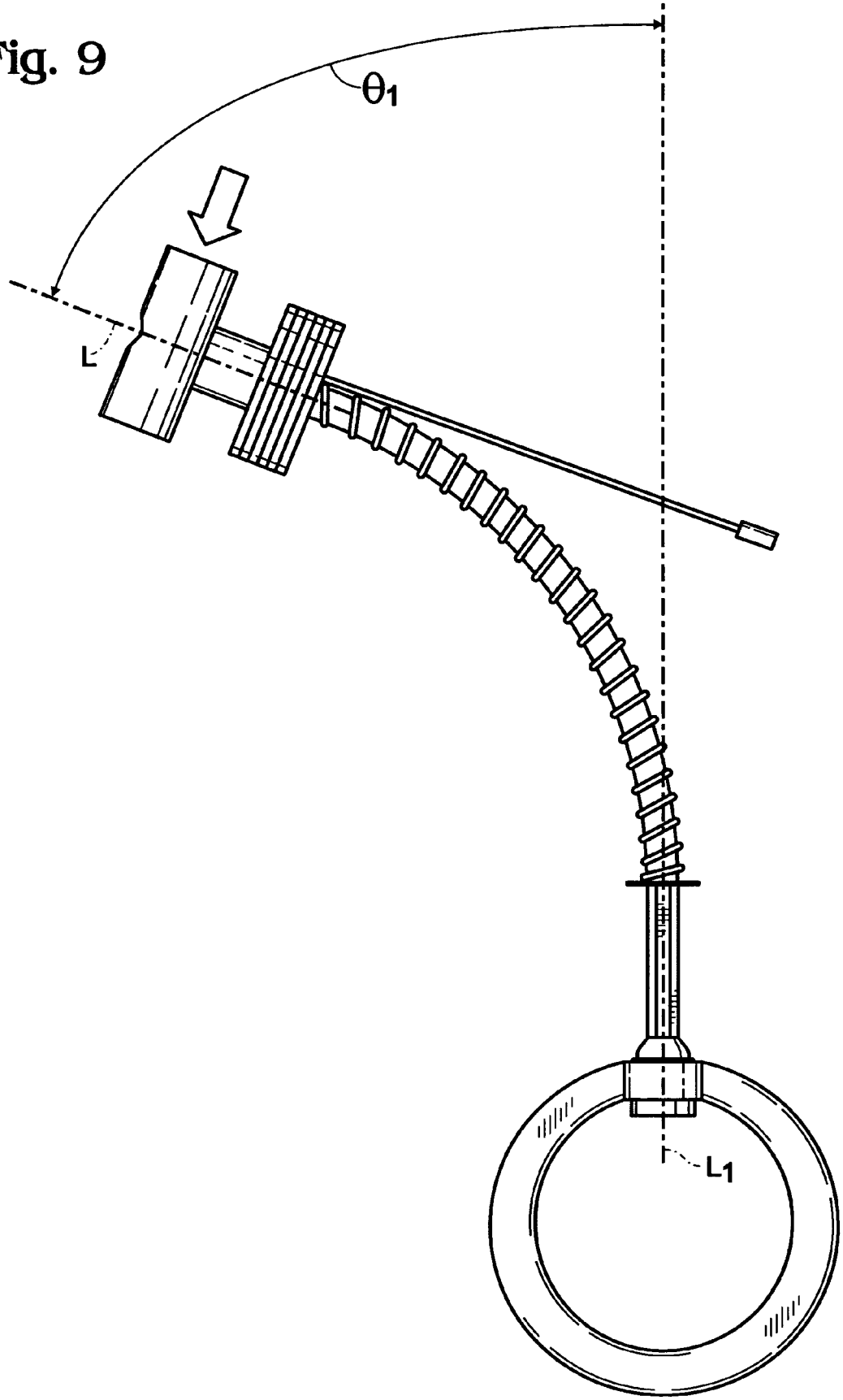
FIG. 9 is a three-dimensional view of the anchor bolt of FIG. 8 flexibly bending in response to off-axis forces.

FIGS. 8 and 9 show the handle 16 as a rigid loop, typically cast of steel or aluminum, defining an aperture A1 therethrough. As shown, the loop is an annulus and therefore has a substantially circular form, however any other shape could be used. The handle 16 in this embodiment is closed, i.e., it extends circumferentially ("C") through a full 360 degrees and therefore completely surrounds the aperture A1. Its function is to provide a form to which a coupling mechanism 22, such as a caribiner (which is typically part of a lanyard) can be attached. Because the handle is closed, the coupling mechanism cannot accidentally become removed from the handle, and so a closed embodiment is preferred.

Figure 15:
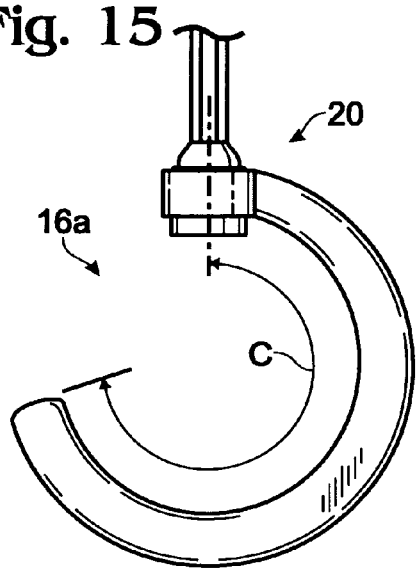
FIG. 15 is a three-dimensional view of an alternative handle member according to the invention.

However, FIG. 15 shows a handle 16*a* that is a modification of the handle 16 of FIGS. 8 and 9, wherein the handle extends circumferentially through less than 360 degrees. This is not preferred, but it is possible to hook a coupling mechanism to a handle that is not closed. However, in such case the circumference C as indicated, referenced from the axis L (shown as being vertical), should extend through at least about 240 degrees, and more preferably at least about 270 degrees.

Figure 16:
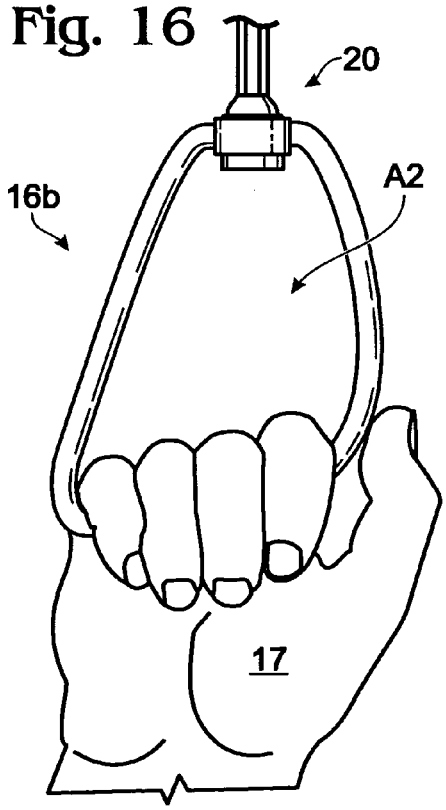
FIG. 16 is a three-dimensional view of another alternative handle member according to the invention.

FIG. 16 shows handle 16*b* that is particularly adapted for grasping by a human hand 17. It is preferably formed of the same cabling that is utilized in the cable 12, such as by being an extension thereof, and is therefore preferably flexible. It is also preferably sleeved in a sheath, to provide for a more comfortable grip. The loop defines an aperture A2 through which the fingers and thumb of the hand may be extended.

Returning to FIGS. 8 and 9, whatever form is provided for the handle 16, it is, according to the invention, pivotally mounted to the cable 12 at a pivot joint 20, adapted so that the handle may pivot azimuthally ($\theta_2$) about the axis L, as that axis extends through the point of attachment of the handle to the cable 12, at the end 12*b* (illustrated in FIG. 9—see portion $L_1$ of the axis L).

Figure 17:
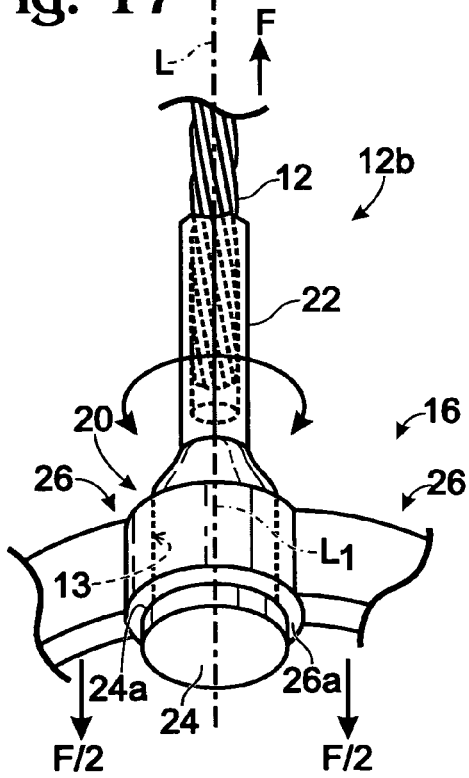
FIG. 17 is a three-dimensional broken view, looking upwardly, of the handle member of FIGS. 8 and 9.

The joint 20 may be formed in any number of ways known to persons of ordinary skill in the mechanical arts. Referring to FIG. 17, a simple and therefore preferred embodiment is to provide a shank 22 extending through a hole 23 in an upper boss 26 of the handle 16. The shank is slightly undersized so that there is a slight amount of clearance between the shank and the hole, e.g., 0.010"-0.020." The shank has a cap 24, which may be secured to the shank or integrally formed with the shank, that is of larger diameter than the hole 23 so that the shank cannot be pulled through the hole in response to a force "F" pulling on the cable 12. An upper surface 24*a* of the cap thereby supports, by engagement with a corresponding lower surface 26*a* of the boss, the load presented by F. Accordingly, pivoting of the handle 16 is resisted by the frictional force between these mating parts, and so it is preferable to machine them to a smooth finish if a smooth finish is not otherwise naturally obtained.

Figure 18:
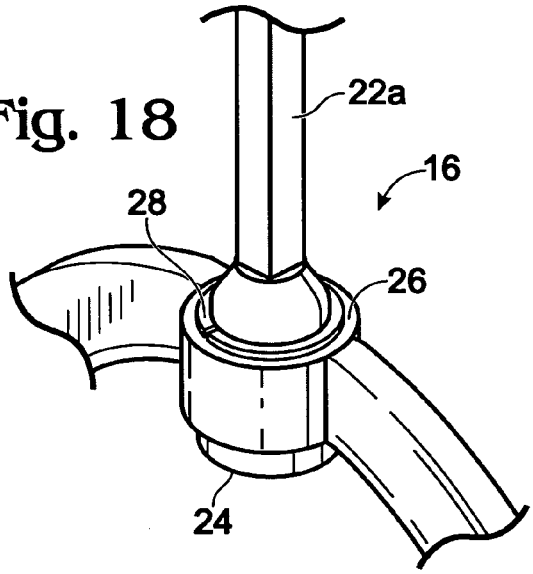
FIG. 18 is a three-dimensional broken view, looking downwardly, of the handle member of FIG. 17.

Referring back to FIG. 8 and to FIG. 18, preferably, a retaining member 28 is also provided to retain the handle 16 from sliding upwardly along the shank, which can occur if the force F is not being applied. The retaining function could be provided in numerous ways, as will be readily appreciated by persons of ordinary mechanical skill, one of which is shown by which the retaining member 28 is a retaining ring, such as circlip, inserted into a groove (not shown) in the shank 22. As just one the many possible alternatives, the shank could be threaded to receive a nut or locknut where the clip is shown.

The cable 12 may be received into an upper portion 22*a* of the shank 22 at the cable end 12*b*, and the upper portion 22*a* may be swaged to the cable. Preferably, the pivot joint 20 allows for rotation of the handle 16 through an azimuthal angle $\theta_4$ of more than 360 degrees about the axis L relative to a fixed orientation of the cable 12. However, the joint 20 could, less preferably, permit a maximum of 360 degrees of rotation, and the joint could, still less preferably, provide for pivoting for less than a full 360 degrees of rotation; however, the joint should provide for at least 180 degrees of rotation so that, pivoting either one way or the other, a full 360 degree range of rotation can be accommodated. In addition, the pivot joint is preferably made to be sufficiently frictionless that insignificant twist of the cable 12 about the axis L, preferably less than 10 degrees, should occur over the entire range of rotation of the handle when the anchor bolt is in normal use.

The coupling mechanism 22 is not part of the invention and may be any known device providing an attachment function. Typically, the coupling mechanism is attached to a lanyard, rope or cable which is secured to the user via a harness.

It is to be understood that, while a specific anchor bolt has been shown and described as preferred, other configurations could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed:

1. An anchor bolt for temporarily attaching to a structure having an anchoring aperture therein or therethrough, to provide fall protection to a user, the anchor bolt comprising:

an elongate flexible member defining, along its length, an elongate axis, and having first and second ends;

an anchoring device connected to said flexible member at said first end, said anchoring device being adapted so that, by use of manual manipulation that is either direct or remote, the user can cause said anchoring device to adopt at least two different configurations or orientations, a relatively contracted or narrow configuration or orientation in which said anchoring device is effectively dimensionally suitable for manual insertion into or through the aperture, and a relatively expanded or bluff configuration or orientation in which said anchoring device is effectively dimensionally unsuitable for removal from or through the aperture without substantial resistance; and a handle member pivotally attached to said second end, for pivoting about the elongate axis as it extends from said second end.

2. The anchor bolt of claim 1, wherein said anchoring device is of the expansion type, comprising at least two wedging members that slide relative to one another to cause an effective dimensional expansion or contraction of the anchoring device in a direction that is substantially perpendicular to the elongate axis as it extends from said first end.

3. The anchor bolt of claim 1, wherein said anchoring device is of the toggling type, comprising an elongate toggling member that is pivotally attached to said flexible member.

4. The anchor bolt of claim 3, wherein said toggling member is pivotally attached to said flexible member at a ball joint.

5. The anchor bolt of claim 4, wherein said toggling member is elongate and has a maximum dimension in a direction perpendicular to its elongate axis, wherein said maximum dimension defines a diameter of a cylindrical surface of said toggling member.

6. A toggle bolt for temporarily attaching to a structure having an aperture therethrough, to provide for fall protection, comprising:

an elongate flexible member defining, along its length, an elongate axis and having an end; and an anchoring device connected to said flexible member at said end, said anchoring device being adapted so that, by use of manual manipulation that is either direct or remote, the user can cause said anchoring device to adopt at least two different configurations or orientations, a relatively contracted or narrow configuration or orientation in which said anchoring device is effectively dimensionally suitable for manual insertion into or through the aperture, and a relatively expanded or bluff configuration or orientation in which said anchoring device is effectively dimensionally unsuitable for removal from or through the aperture without substantial resistance, wherein said anchoring device includes a toggling member for adopting said orientations, said toggling member being pivotally attached to said cable at said end at a first ball joint so that said toggling member is permitted to pivot about the elongate axis and at least one axis perpendicular thereto.

7. The toggle bolt of claim 6, wherein said toggling member is elongate and has a maximum dimension in a direction perpendicular to its elongate axis, wherein said maximum dimension defines a diameter of a cylindrical surface of said toggling member.

8. The toggle bolt of claim 7, wherein said relatively expanded or bluff configuration or orientation corresponds to a locking position of said toggling member, and wherein said toggling member has a substantially planar surface that is substantially perpendicular to the elongate axis of said toggling member when said toggling member is in said locking position.

9. The toggle bolt of claim 8, wherein the aperture is a round hole, further comprising a hole plug slidably disposed about said flexible member, said hole plug having a substantially cylindrical hole plugging portion.

10. The toggle bolt of claim 9, further comprising a spring for biasing said hole plug toward said toggling member.

11. The toggle bolt of claim 10, further comprising an elongate control member pivotally attached to said toggling member and extending through said hole plug to provide for remotely pivoting said toggling member.

12. The toggle bolt of claim 11, wherein said control member is pivotally attached to said toggling member at a second ball joint.

13. The toggle bolt of claim 9, further comprising an elongate control member pivotally attached to said toggling member and extending through said hole plug to provide for remotely pivoting said toggling member.

14. The toggle bolt of claim 13, wherein said control member is pivotally attached to said toggling member at a second ball joint.

15. The toggle bolt of claim 6, wherein the aperture is a round hole, further comprising a hole plug slidably disposed about said flexible member, said hole plug having a substantially cylindrical hole plugging portion.

16. The toggle bolt of claim 15, further comprising a spring for biasing said hole plug toward said toggling member.

17. The toggle bolt of claim 16, further comprising an elongate control member pivotally attached to said toggling member and extending through said hole plug to provide for remotely pivoting said toggling member.

18. The toggle bolt of claim 17, wherein said control member is pivotally attached to said toggling member at a second ball joint.

19. The toggle bolt of claim 15, further comprising an elongate control member pivotally attached to said toggling member and extending through said hole plug to provide for remotely pivoting said toggling member.

20. The toggle bolt of claim 19, wherein said control member is pivotally attached to said toggling member at a second ball joint.

21. The toggle bolt of claim 6, further comprising an elongate control member pivotally attached to said toggling member for remotely pivoting said toggling member.

* * * * *